US006357554B1

(12) United States Patent
Valk et al.

(10) Patent No.: US 6,357,554 B1
(45) Date of Patent: Mar. 19, 2002

(54) ELEVATOR RIDE IMPROVEMENTS UTILIZING SMART FLOOR

(75) Inventors: Mary Ann Valk, Glastonbury; David J. Sirag, Jr., Ellington; Robert G. Morgan, Bolton, all of CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/613,398

(22) Filed: Jul. 11, 2000

(51) Int. Cl.[7] ..... B66B 1/44
(52) U.S. Cl. ..... 187/391; 187/292
(58) Field of Search ..... 187/391, 392, 187/393, 281, 292

(56) References Cited

U.S. PATENT DOCUMENTS

| | | | | | |
|---|---|---|---|---|---|
| 3,168,164 | A | * | 2/1965 | Kiely | 187/392 |
| 3,543,883 | A | * | 12/1970 | Kuzara | 187/292 |
| 4,555,724 | A | * | 11/1985 | Enriquez | 187/29 R |
| 4,839,631 | A | | 6/1989 | Tsuji | 340/541 |
| 4,951,786 | A | * | 8/1990 | Haraguchi | 187/1 R |
| 5,020,639 | A | * | 6/1991 | Michel | 187/1 R |
| 5,068,537 | A | * | 11/1991 | Ishikawa et al. | 250/342 |
| 5,258,587 | A | * | 11/1993 | Kezer et al. | 187/131 |
| 5,487,451 | A | * | 1/1996 | Hughes et al. | 187/392 |
| 5,531,294 | A | * | 7/1996 | Burton et al. | 187/292 |
| 5,932,853 | A | | 8/1999 | Friedli et al. | 187/392 |

FOREIGN PATENT DOCUMENTS

| | | | |
|---|---|---|---|
| JP | 5-294585 | * | 5/1983 |
| JP | 6-32564 | * | 6/1994 |
| JP | 6-234476 | * | 6/1994 |
| JP | 6-321453 | * | 6/1994 |

* cited by examiner

*Primary Examiner*—Jonathan Salata

(57) ABSTRACT

Elevator cars (10) have floors (11) including a matrix of elements (12) including a weight sensing cell (18) to determine weight distribution in the car for controlling the position of a moveable hitch (33–36) on the car and for allocating calls to the cars depending upon the weight distribution. Transmitters (26) borne by passengers (25) transmit identification portions, and may also transmit personal preferences of the passenger with respect to the elevator ride. The system may store personal preferences in a data base indexed by personal identification numbers, limiting the required transmission to only the identification number. Correlation (FIG. 4) of identification numbers with the cell indicating by weight where a passenger is located may be achieved in each element of the floor or in a controller. A group controller (22) may allocate calls based upon weight distribution and/or preferences of passengers.

4 Claims, 3 Drawing Sheets

ELEVATOR RIDE IMPROVEMENTS UTILIZING SMART FLOOR

TECHNICAL FIELD

This invention relates to use of a smart floor in elevators to assist in ride comfort through improved space allocation and rope hitch location.

BACKGROUND ART

Recent innovations in elevators, such as in U.S. patent application Ser. No. 09/189,161 have utilized so-called "smart cards" which transmit information from a potential passenger to the elevator to place destination calls for service, and to otherwise identify some characteristic of the passenger. However, such improvements have not addressed the problem of improving the quality of the passenger's ride.

DISCLOSURE OF INVENTION

Objects of the invention include improving riding comfort in an elevator; improved elevator ride qualities; and improved passenger comfort within an elevator.

According to the present invention, a smart floor in an elevator is utilized to determine the exact weight distribution of passengers within an elevator car, which may be used to locate at least one coordinate of the center of gravity for lifting of the car, and coordinating passenger information with occupied space by means of transmissions received from a smart card, which information may be utilized to improve rider comfort.

According to the invention further, an elevator car has a smart floor consisting of a grid of elements, each element having a weight sensor, such as a piezoelectric element, an RF receiver including an antenna, and circuitry to process signals from the receiver and the rate sensor and providing resultant signals to the elevator controller. In still further accord with the present invention, the distribution of weight within the elevator may be determined by the weight sensor elements, and utilized to control at least one axis of an adjustable hitch so as to support the elevator more directly in line with the present center of gravity. In accordance with the invention still further, information about the passenger, localized to the particular position within the elevator, may be utilized to allocate calls to cars and advise passengers at landings in a manner to manage the tradeoff between travel time and passenger density in a car.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
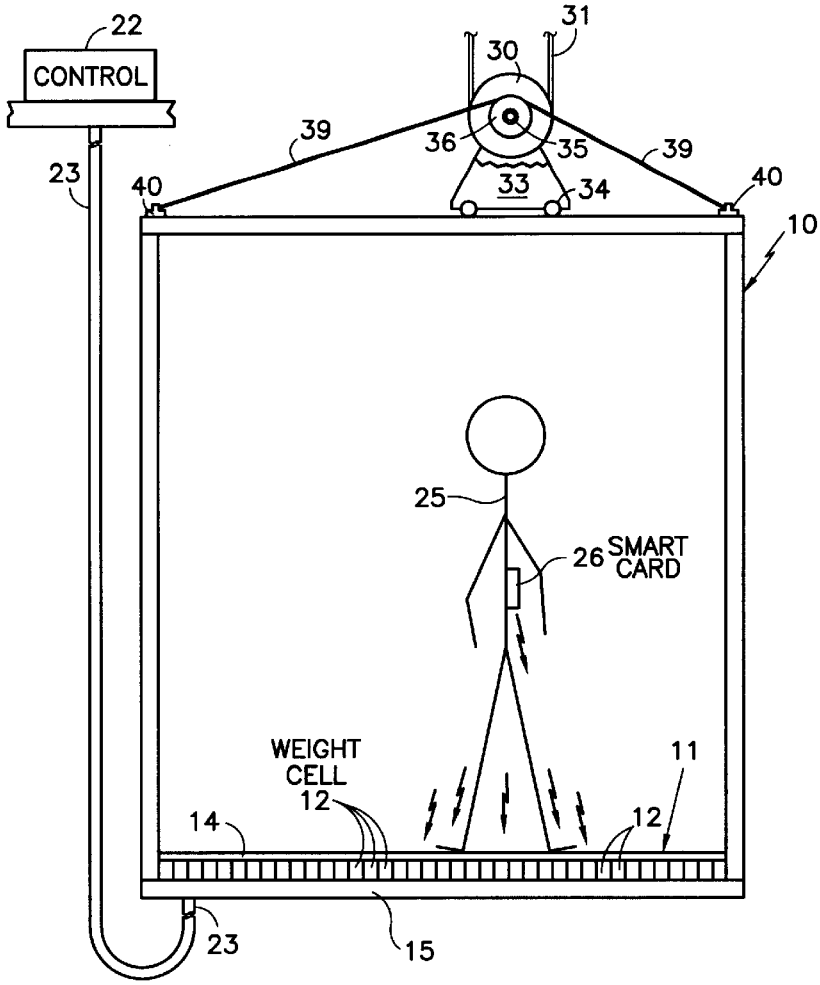
FIG. 1 is a simplified, stylized sectional front elevation of an elevator incorporating the invention.
Figure 2:
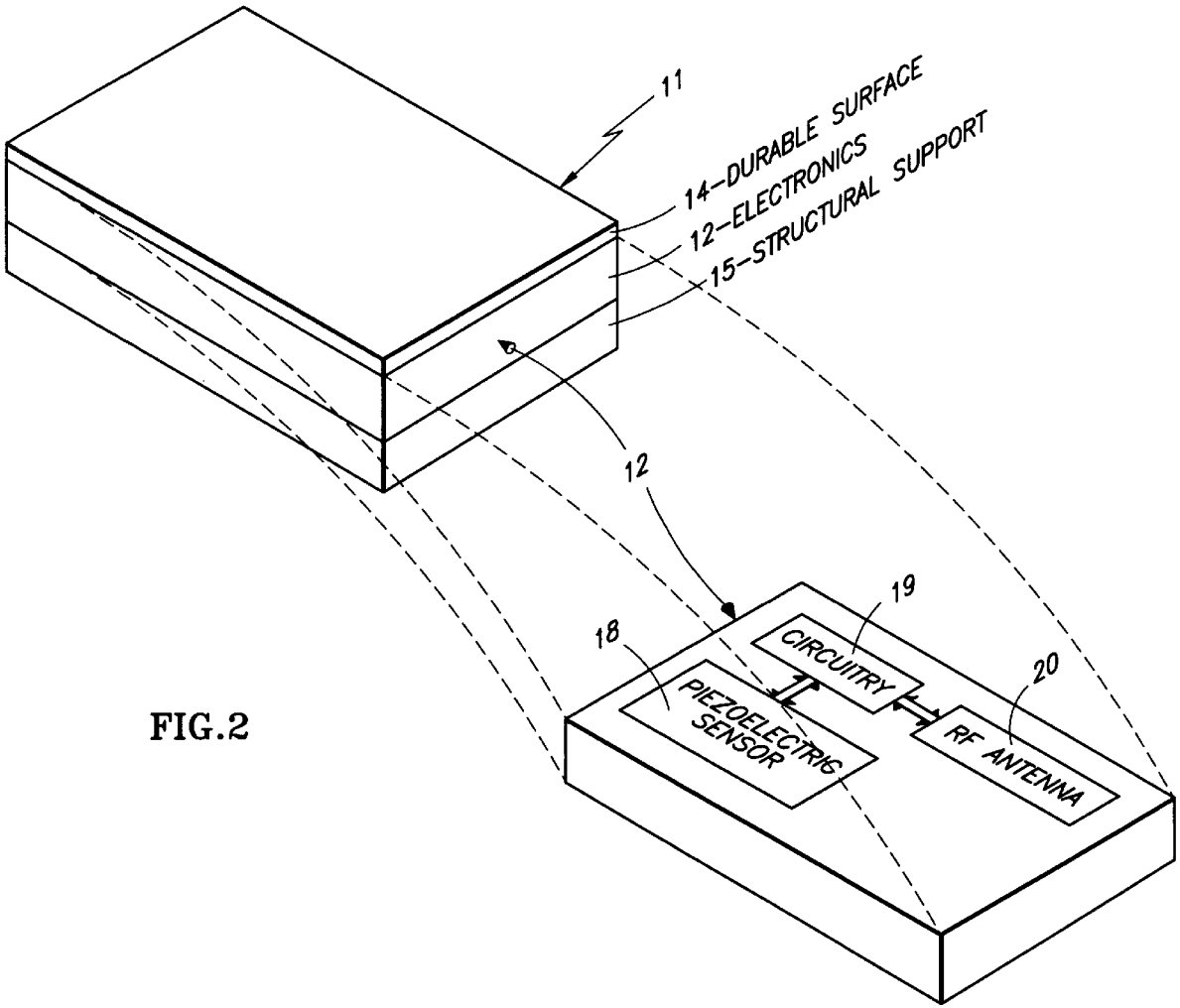
FIG. 2 is a simplified, perspective illustration of a smart floor in accordance with the present invention with the outline of a passengers foot thereon.

Referring to FIG. 1, an elevator 10 has a smart floor 11 comprising a matrix of individual electronic units 12, the floor 10 also has an upper, durable surface 14, and a lower, structural support layer 15 that will sustain normal loading in an elevator. Assume in FIG. 2 that each cell 12 has a piezoelectric sensor 18 and circuitry 19 which not only processes the piezoelectric signals to provide a signal manifestation of weight applied to the piezoelectric sensor 18, but also includes an RF receiver which processes signals from an antenna 20. Signals from the circuitry 19 are transferred to the elevator control 22 (FIG. 1) by an suitable means, such as by RF signal transmissions, or by means of a traveling cable 23 and additional circuits as may be required.

Figure 3:
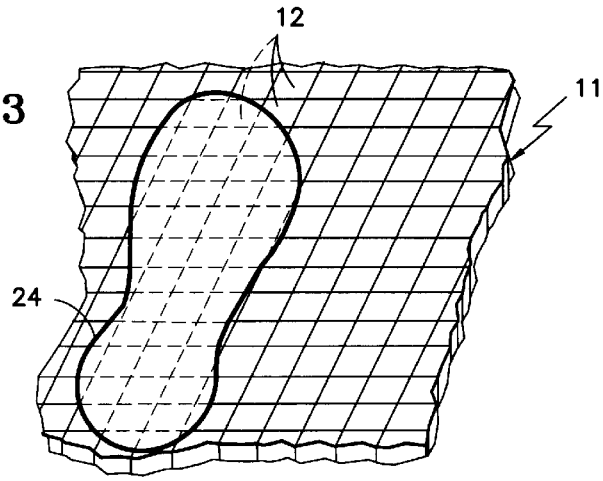
FIG. 3 is a perspective illustration of a single cell of the smart floor of the invention shown in FIGS. 1 and 2.

In this embodiment, the cells 12 will be approximately two and one-half centimeters (one inch) on a side, so as to be much smaller than the footprint 24 of a passenger 25, as is illustrated in FIG. 3.

As illustrated in FIG. 1, a passenger 25 may carry a smart card 26 which transmits, at a minimum, the identification of the passenger 25. Assuming that the power of transmissions from the smart card 26 is relatively low, by utilizing antennae 20 which are highly directional, each cell 12 will be able to distinguish from amplitude alone the transmission that is from the passenger which is imposing weight upon the piezoelectric sensor 18 of that cell. A correlation function is described with respect to FIG. 4, hereinafter. Thus, numerous cells (as seen in FIG. 3) will be receiving maximal signals from the same smart badge, as determined by the transmitted identity of the smart badge 26, thereby identifying the particular passenger 25 causing the particular weight signals. Thus, the location of an individual within the car is determined. This correlation between the identification of the passenger with the passenger's position in the car can be used with similar data from other passengers to determine whether or not passengers are within their stated tolerance of crowding, and therefore provide an indication that further passengers should not be encouraged to enter the car until one or another of the registered passengers leave the car. As an example, if the car were to stop in order for passengers to exit the car, an announcement may indicate that this car is relatively full and an/other car will be along shortly, or other words to that general effect. On the other hand, the information about crowding may be utilized so as not to allocate a hall call to this particular car until the crowding is relieved. To assist in this type of control, passengers can register their desire to be left alone with lots of personal space in the elevator car, or a preference to be moved as quickly as possible from one floor to another.

The particular pattern of weight distribution in the elevator car determined from the cells 12 may be utilized, as illustrated in FIG. 1, so as to support the elevator car more nearly from its center of gravity, at least in one axis. In FIG. 1, a car hitch, which in this case comprises an idler sheave 30 about which the rope 31 (usually comprising several steel cables) is wrapped, may be moved from side to side on a dolly 33 having wheels 34, the dolly supporting an axle 35 upon which the sheave 30 is free to rotate, and upon which a pulley 36 may rotate so as to draw the dolly to the right or to the left some limited amount as shown, by means of a cable 39 which is fixed at either end at anchors 40, and which is doubly or triply wrapped around the pulley 36 so that as the pulley is rotated, the position of the dolly 34 will move to the right or to the left, accordingly. The pulley 36 is rotated by a motor (not shown for clarity) fixed to the dolly 33. In this example, providing the lift to the elevator at a point more nearly aligned with its center of gravity avoids tilting against the elevator rails and a commensurate roughness of ride which results from additional pressure of the elevator guides interacting with imperfections in the rails. If desired, orientation of the hitch in the fore and aft direction of the elevator car may be provided as well or instead by any suitable mechanisms. As used herein, the term "hitch" means not only traditional, rope-end-terminating hitches, but rotary hitches such as the idler sheave 30. Other hitches may be moved by means of jack screws or any other conventional mechanisms in order to implement any desired embodiment of the invention.

Figure 4:
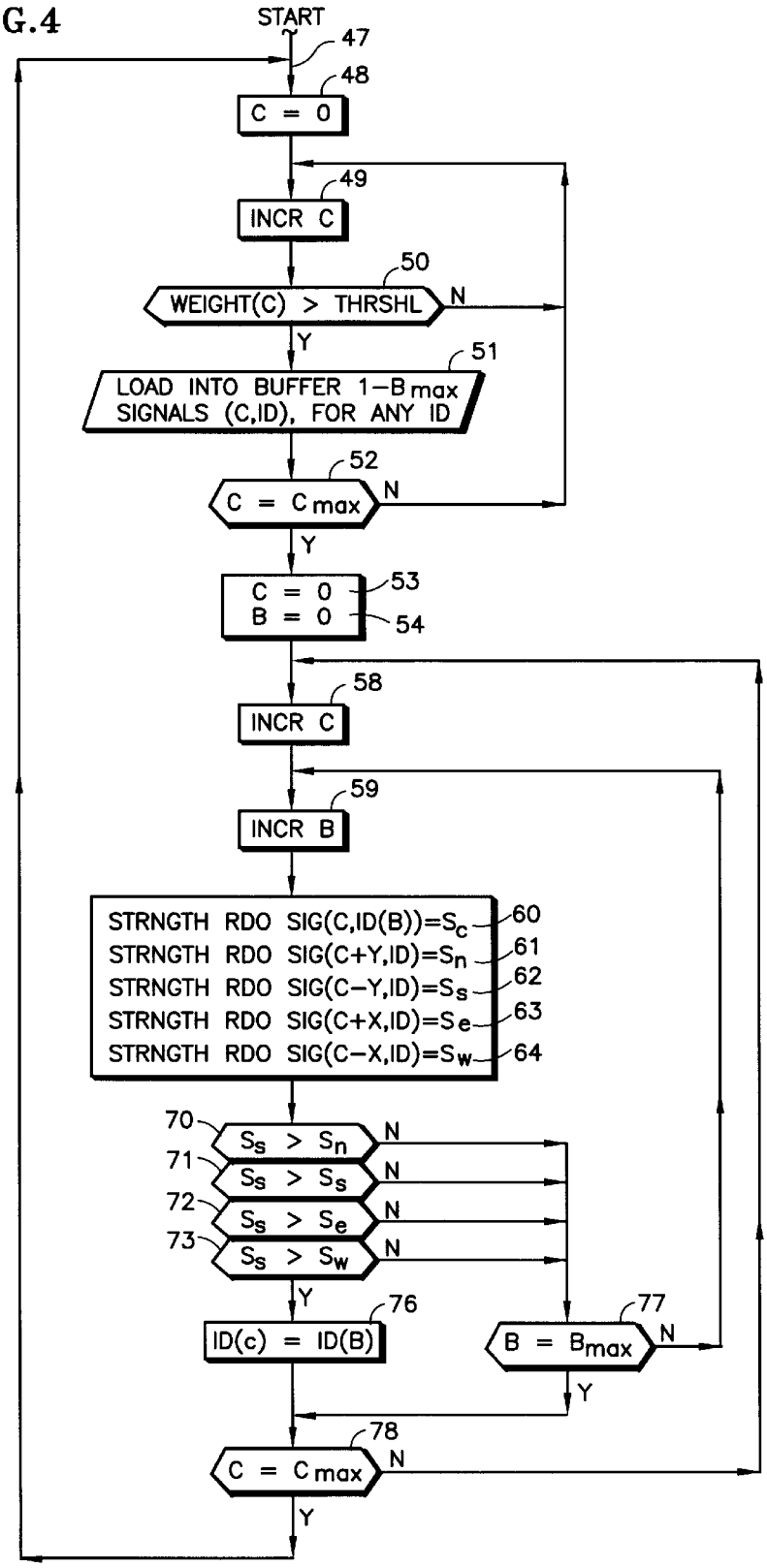
FIG. 4 is a high level functional flow diagram illustrating the determination of the particular passenger who causes a weight pattern.

A correlation function for determining the identification of a passenger causing a weight response on the floor is illustrated in FIG. 4. It is assumed that this program can be run in a parallel processing fashion, either in the circuitry 19 of each cell 12, or in a control 22, such as a car controller, or in a multi-elevator system, a group controller. When performed in the computer, there may be several distinct routines handling some fraction of the total number of cells in the floor, or the program may be run continuously encompassing all the cells in the floor. The version of the correlation function illustrated in FIG. 4 is one which would be operated in control 22, rather than in circuitry 19 for a single cell.

After initialization, the routine of FIG. 4 begins at a start point 47 and a first step 48 sets a cell counter, C, to zero. Then a step 49 increments the C counter, and a test 50 determines if cell C registers more than a threshold weight; if not, the routine reverts to step 49 to consider the next cell in turn. A subroutine 51 will load into buffers signals, C (ID), representing any independent ID signal received at the cell C, including an ID number and a portion indicating the signal strength of the received signal bearing that ID number. Then a test 52 determines if all of the cells being handled by this routine have been examined for received signals, or not. If not, the program reverts to the step 50 to load buffers for an additional cell. When buffers are loaded for all of the cells handled by this routine, an affirmative result of test 52 reaches a pair of steps 53 to again set the C counter to zero and to set a buffer counter, B, to zero. Then a pair of steps 58, 59 increment the C counter and the B counter. A plurality of steps 60–64 record the strengths indicated by radio signals determined in the circuitry 19 of the various cells, where the strengths of the cells C under examination for the identification number lodged in buffer B is set equal to Sc. And then the strengths of the radio signals provided by four cells immediately contiguous to cell C are recorded as north, south, east and west strengths in the steps 61–64. Then a series of tests 70–73 compare the strength of the particular identification signal in the buffer under examination for the cell C with the strengths for the signals of the same identification number for the four contiguous cells. If the strength of cell C is greater than the strength for each of the contiguous cells, an affirmative result of all of tests 70–73 will reach a step 76 to set the identification for cell C equal to the identification number in the buffer, B, in which that ID is stored for cell C. In this routine, the buffers are associated with the cell numbers, when put into use, and therefore will fall contiguously with each C number. If any of the four contiguous signal strengths are not less than those of the cell under consideration for the particular ID, then a negative result of one of the tests 70–73 will cause the step 76 to be bypassed. Then a test 77 determines if all of the buffers associated with cell C have been examined, or not. If not, the routine reverts to step 59 to examine the relationships for another ID number.

When either a maximum is found in the steps 70–73 and the ID for cell C is recorded in step 76, or when all of the buffers for cell C have been tested without a match, causing an affirmative result of test 77, a test 78 determines if all of the cells have been tested or not. If not, the program reverts to step 58 to perform the tests for the next cell in turn. But if all of the cells have been tested, the program reverts to step 48 so as to begin the process all over again, utilizing newly received signals in all of the cells.

The elevator control 22 may be a car controller, or a group controller or a controller performing at least some of car or group functions, or both.

The patterns of weight distribution in the elevator car may also be utilized to detect abnormal situations, such as the presence of vandals or robbers, if desired. That is, if the patterns change quickly and consistently, the presence of vandals may be expected. If the pattern provides for a great deal of weight along one wall of the elevator and a single passenger's amount of weight on another wall, this might be taken as an indication of a robbery in progress.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. An elevator system, comprising:

a controller;

a car;

a floor of said car having a layer comprising a matrix composed of a plurality of distinct elements, there being a plurality of said elements within a single footprint of any passenger at any position on said floor, each element comprising a cell for providing a weight signal proportional to the weight of any passenger disposed above the corresponding element;

said controller responsive to said weight signals to provide distribution signals indicative of the distribution of weight in said car;

said car having a hitch connected to a rope engaging a drive sheave, said hitch being moveable in at least one of a fore and aft direction and a side-to-side direction; and said controller responsive to said distribution signals to move said hitch in said fore and aft and/or side-to-side direction to cause said hitch to be closer to a vertical line through the present center of gravity of said car.

2. An elevator system, comprising:

a controller;

a car;

a floor of said car having a layer comprising a matrix composed of a plurality of distinct elements, there being a plurality of said elements within a single footprint of any passenger at any position on said floor, each element comprising a cell for providing a weight signal proportional to the weight of any passenger disposed above the corresponding element;

said controller responsive to said weight signals to provide distribution signals indicative of the distribution of weight in said car;

a plurality of transmitters, each borne by a prospective passenger, each transmitting an RF signal including at least a passenger identification portion;

the elements of said car each comprising an RF receiver with an antenna for receiving said RF transmissions, if any, and for providing (a) radio signals indicative of the strength of the received RF transmissions, if any, and (b) ID signals indicative of the identification of the passengers bearing said transmitters; and a correlator function for correlating, for each of said elements, the strengths indicated by said radio signals with the presence of said weight signals, thereby to identify the location on said floor of each passenger in said car.

3. A system according to claim 2 wherein:

said correlator function is executed within each element with respect to respective transmissions received thereby.

4. A system according to claim 2 wherein:

said correlator function is executed within said controller.

* * * * *